US005863088A

United States Patent [19]

Kelly, Sr. et al.

[11] Patent Number: 5,863,088

[45] Date of Patent: Jan. 26, 1999

[54] FOLDING CHAIR AND ACCESSORY CARRIER

[76] Inventors: Charles J. Kelly, Sr., 2953 Parkview La., Allentown, Pa. 18103-5515; Ann K. McGeary, 1957 Delancy St., Hellertown, Pa. 18055

[21] Appl. No.: 853,060

[22] Filed: May 8, 1997

[51] Int. Cl.[6] ..... B65D 37/00

[52] U.S. Cl. ..... 294/146; 294/152; 294/165

[58] Field of Search ..... 294/138, 141, 294/146, 147, 149–153, 156, 159, 165; 383/4; 5/417–420; 190/1

[56] References Cited

U.S. PATENT DOCUMENTS

| | | | |
|---|---|---|---|
| 726,119 | 4/1903 | Trognitz | 294/138 |
| 841,902 | 1/1907 | Shumard | 294/150 |
| 1,689,416 | 10/1928 | Wood | 294/138 |
| 2,422,235 | 6/1947 | Greene | 294/138 |
| 3,368,655 | 2/1968 | Purdy | 294/146 |
| 4,188,988 | 2/1980 | Agyagos | 5/417 |
| 4,958,759 | 9/1990 | Jarvis | 294/138 |
| 5,031,733 | 7/1991 | Chang | 383/4 |
| 5,210,891 | 5/1993 | Avital et al. | 5/419 |
| 5,251,945 | 10/1993 | Stoops | 294/152 |
| 5,641,199 | 6/1997 | Bond-madsen | 383/4 |

*Primary Examiner*—Dean Kramer
*Attorney, Agent, or Firm*—Ratner & Prestia

[57] ABSTRACT

An article carrier formed from a rectangular sheet made of flexible, foldable material folded along a midline of the longer sides of the sheet forming first and second sides having inner and outer faces, a plurality of cooperating adjustable length fasteners attached to juxtaposed surfaces at spaced apart locations on each of the three free edges of the sides of the carrier such that when the adjustable fasteners are joined together, a carrying space is formed between the sides of the carrier. A plurality of article carriers are arrayed across the outer surface of one of the sides and adapted to fit and transport articles of various sizes and shapes, and a pair of handles are attached along the shorter edge of the rectangular sheet used to form the carrier. The carrier also has a plurality of external attachments for securing and carrying bulky articles and an internal pocket.

10 Claims, 2 Drawing Sheets

FOLDING CHAIR AND ACCESSORY CARRIER

BACKGROUND OF THE INVENTION

The present invention generally relates to a carrier configured and adapted to contain one or more folding chairs, an extendable umbrella or chair umbrella, and a multiplicity of pockets for carrying refreshments or foodstuffs, periodicals, and items of apparel, as well as number of utility loops for suspending bulkier articles along the exterior of the carrier. The invention is a combination mat and carrier which may be converted from its carrier mode and extended to be spread on the ground creating a surface upon which a person can lie or sit.

There are a number of combination tote bags and lounge sets or mats which covert from a carrier or tote to a mat providing a surface upon which one can lie. One example of such combination is U.S. Pat. No. 4,197,891 [Comollo] for a "Combination Beach Mat and Shoulder Bag", which bag is convertible into a mat by unfolding the flexible material to assume the shape of a larger rectangular mat. When in the folded bag mode, the combination is capable of retaining and carrying articles of clothing to be worn on the beach.

Another example is the combination of a beach mat and tote bag is described in U.S. Pat. No. 5,110,219 [Lopes] which describes a single rectangular sheet folded in half with connecting straps at the distal opposing edges of the folded rectangular sheet for creating the tote. When the sheet is to be unfolded, the connecting straps and side zippers of the tote are disengaged and the rectangular flexible material can be laid flat on the ground. Another example of a combination convertible bag and mat is described in U.S. Pat. No. 4,991,245 [Franco] which describes a rectangular sheet of flexible material convertible to a tote bag for carrying articles by folding portions of the rectangular sheet over and upon one another forming interior article-holding compartments.

A yet further example of a beach bag or tote which is convertible for alternate use is shown in U.S. Pat. No. 4,180,112 [Bovet] where the tote bag can be opened to provide a shield against sun or wind. The bag is opened and a stiffening or reinforcing member is positioned so that the bag resembles an open book in an upright position so as to provide the described shield. None of these patents contemplate a carrier capable of transporting one or more folding chairs in combination with carrying an umbrella and other articles necessary for the recreational activity, whether such activity be sitting on a beach at an ocean or a lake, or around a swimming pool.

It is, therefore, an object of the present invention to provide a combination carrier having sufficient flexibility to accommodate one or more folding chairs, an umbrella, and numerous other articles to be placed in pockets or attached through utility loops to the carrier so that the multiplicity of items can be transported from one location to another location by a single individual.

Other objects will appear hereinafter.

SUMMARY OF THE INVENTION

The present invention is best described as an article carrier apparatus which comprises a series of elements. The first element is a rectangular sheet made of flexible, foldable material folded along a midline of the longer sides of the sheet which forms first and second sides of the carrier with each of these sides having inner and outer faces. A plurality of cooperating adjustable length fastener means are attached to the carrier sides at spaced apart locations of juxtaposed surfaces along each of the three free edges of the sides of the carrier such that when the fastener means are joined together, a carrying space is formed between said sides of said carrier. A plurality of article containing means are arrayed across the outer surface of one of the sides of the carrier and adapted to fit and transport differently dimensioned and sized articles which are comprised of side-pinch adjustable strap buckle arrangements. The final element is a pair of handles attached along the edge positioned distally away from the midline of said carrier.

The carrier apparatus also includes an expandable pocket on the inner surface of one of the sides which is dimensioned to extend substantially across that inner surface to a width in the range of 18 to 20 inches and to extend vertically along the side to a height in the range of 16 to 18 inches.

The plurality of article retaining means on the outer surface of one of the sides is a series of upwardly opening vertically oriented pockets arrayed horizontally across that side from free edge to free edge having a vertical dimension in the range of 10 to 12 inches, the outer pockets having a horizontal dimension in the range of 6 to 8 inches, and the center pocket having a horizontal dimension in the range of 8 to 9 inches. An additional article retaining means is a horizontally extending pocket adjacent to the midline of said carrier and extending horizontally from free edge to free edge with the vertical dimension of this pocket being in the range of 6 to 8 inches in height which is configured to hold and retain elongated articles placed or positioned within said pocket from either end of the pocket.

The carrier apparatus may also have one or more external attachment means for carrying bulky articles along the exterior of said carrier which are comprised of one or more side-pinch adjustable strap buckle arrangements for securing and supporting said article.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
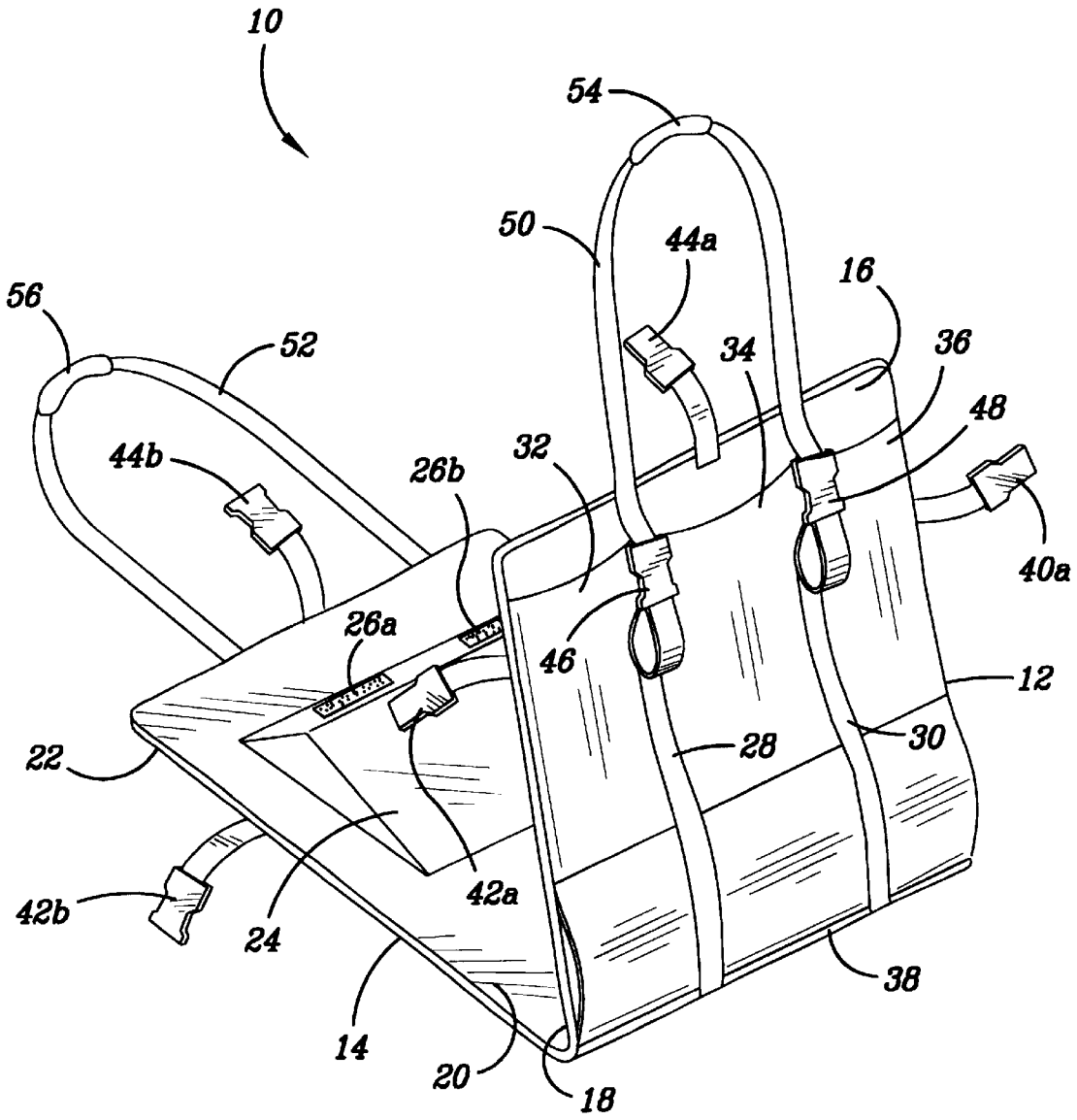
FIG. 1 is a perspective view of the preferred embodiment of the invention showing an unloaded carrier with the various connector means and a plurality of pockets and attachment means.

Referring now to the drawings in detail, where like numerals refer to like parts or elements, there is shown in FIG. 1 the carrier 10 of the present invention. The carrier 10, when laid flat, has the shape of an elongated rectangle with each of the longer sides being approximately twice the length of each of the shorter sides. The carrier 10 is preferred to be manufactured from a flexible material such as polyester, or other lightweight polymer, but may also be made from canvas or other natural fibers.

The carrier 10 is comprised of a first side 12 and a second side 14, each side 12, 14 meeting along the midline of the carrier 10. The first side 12 has an outer face 16 and an inner face 18. The second side 14 has an inner face 20 and an outer face 22. All of the edges and seams of the carrier 10, along the first and second sides 12, 14, have reinforced stitchings to add strength and to prevent deformation of the rectangularity of each of the first and second sides 12, 14. Although a reinforcing liner material could be utilized, as well as a moisture impervious covering over the liner material could be incorporated along the inner faces 18, 20 of the first and second sides 12, 14 of the carrier 10, this is not preferred in order to minimize the weight of the carrier 10. The material from which the carrier 10 is made is preferred to be resistant to tearing and puncturing and have sufficient material strength to withstand material failure for loads in the range of 60 to 75 pounds or up to 150 pounds.

The carrier 10 is configured such that on the outer face 22 of second side 14 there are no outward protrusions or pockets or attachment means for carrying articles against the outer face so that the carrier 10 can snugly fit against the side of the person transporting the carrier 10 without any interference. Thus, the only external features on the outer face 22 of the second side 14 are the reinforcing seams which extend vertically across the outer face 22 in the identical fashion as the reinforcing seams to be described in connection with the outer face 16 of first side 12 hereinafter.

The inner face 20 of second side 14 contains an expandable pocket 24 into which may be placed various items of apparel, including, but not limited to, shirts, cover-ups, hats, shoes, or towels or blankets, or any item which would not be damaged by being folded or scrunched into a confined area. The pocket 24 is preferred to extend horizontally for almost the entire horizontal measurement of the second side 14 and vertically for approximately two-thirds of the vertical length of second side 14 such that the measurements of the expandable pocket 24 are in the approximate range of 20 inches in width and 18 inches in height. The expandable pocket 24 has a temporary closure means for securing whatever articles are contained therein. Cooperating hook and loop type fastener means 26*a*, 26*b* are spaced along the opening of pocket 24 to provide such temporary closure.

As in the case of the outer face 22 of second side 14, the inner face 18 of first side 12 does not support any pockets or attaching means so that there is no interference with the article or articles which may be placed inside the carrier 10. On the opposite face, the outer face 16 of first side 12, there are a number of pockets and attachment means which will be described more fully below.

The side of the carrier 10 which is preferred to face outward from the individual transporting the articles in the carrier 10 is the first side 12, and its outer face 16. Formed on the outer face 16 of first side 12 are a series of pockets 32, 34, 36 and 38. Across the upper portion of the outer face 16 of first side 12, the upper portion being distally positioned away from the midline of carrier 10, are arrayed a series of vertically oriented side pockets 32, 34 and 36. These side pockets 32–36 open upwardly toward the distal edge of first side 12. These pockets have differing horizontal dimensions, but all extend vertically to a height in the range of approximately 10–12 inches. The outer side pockets, 32 and 36, have a width dimension in the range of approximately 6–7 inches. The central side pocket 34 has a width dimension in the range of approximately 8–9 inches. Each of the side pockets 32–36 are separated by reinforcing seams over which extend nylon or fabric tapes 28, 30, which tapes continue over the outer faces 16 and 22 of both the first and second sides 12, 14 in the manner shown in FIG. 1. The fabric tapes 28, 30 provide for a strengthening of each of the first and second sides 12, 14 to prevent deformation during transport of articles.

The lower pocket 38 on the outer face 16 of first side 12 extends horizontally across the portion of the first side 12 proximal to the midline of the carrier 10. This horizontal pocket 38 extends completely from one side to the opposite side of the outer face 16 of first side 12 and has a vertical measurement in the range of approximately 6–8 inches in height.

Attached to each of the three free edges of the first and second sides 12, 14 are three cooperating sets of side-pinch, quick action adjustable fastening means 40*a*, 40*b*, 42*a*, 42*b*, 44*a* and 44*b*. Each of the side-pinch fastener means are comprised of a cooperating buckle arrangement and respective straps attached by sewing to each of the first and second sides 12, 14 of the carrier 10. Each of the fastener means 40, 42 and 44 are adjustable by sliding the straps through the buckles to adjust the length of the fastener means straps to accommodate a greater or lesser load (wider or narrower contents) for the carrier 10.

Attached to the outer face 16 of first side 12 are also two additional side-pinch adjustable fastener means 46, 48 having adjustable length straps which are adapted to carry articles suspended against the exterior of the carrier 10. Each of the straps of fastener means 46, 48 can be lengthened or shortened to adjust the vertical positioning of the article to be carried. Articles are positioned for carrying by opening the cooperating side-pinch buckles, adjusting the length of the strap, and reclosing the buckles of fasteners 46, 48.

Attached along the distal edges of each of the first and second sides 12, 14 are elongated carrying straps 50, 52. The straps have a length sufficient so that the carrier 10 can be transported either at the side of the individual or over the shoulder of the individual. In either case, strap 50 has a cushioning means 54 attached to it at its approximate midpoint with a strap 56 which envelops strap 52 so that both straps 50, 52 are held together, so that the impingement of the straps on the individual is lessened.

Figure 2:
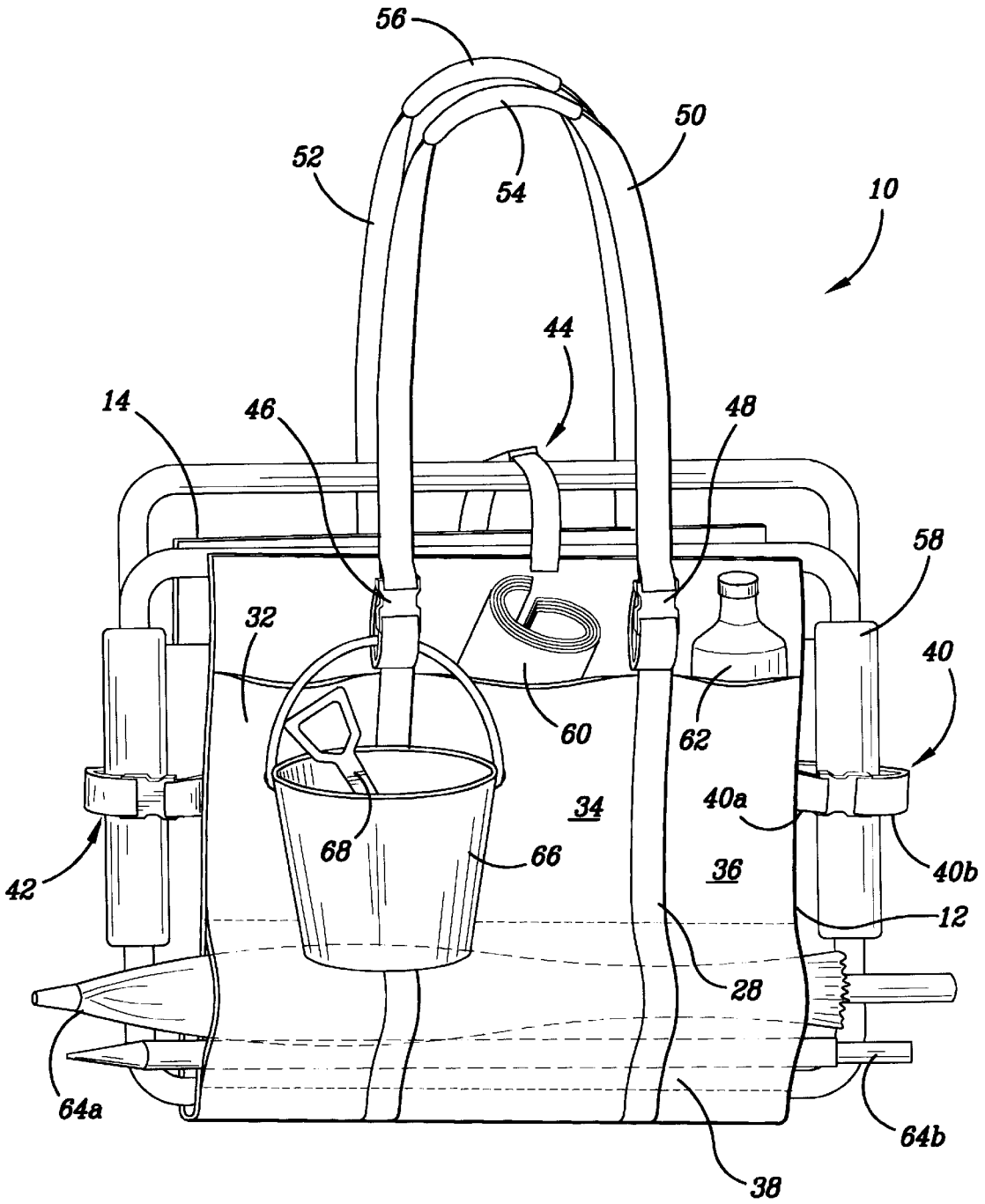
FIG. 2 is a plan view of one side of the present invention showing a proposed loading of the carrier with articles to be transported.

Referring now to FIG. 2, there is shown a variety of articles which are intended to be carried within the carrier 10 of the present invention. Within the space formed between the opposing first and second sides 12, 14, there can be carried one or more folding chairs 58. Each of the fastener means 40, 42 and 44 are utilized to retain the first and second sides 12, 14 in an upright position and secure the folding chair 58 within the space defined by the respective sides of the carrier 10.

Along the outer face 16 of first side 12, the series of pockets are shown to contain a variety of articles. Central side pocket 34 is shown as containing a rolled magazine or periodical 60. Side pocket 36 is shown holding a liquid container or bottle 62 which can hold a variety of fluids for use by the individual utilizing the carrier 10. The other side pocket, side pocket 32, is shown empty, but similar items as those shown in FIG. 2 or other items related to the intended activity for which the carrier is being utilized can be housed within that pocket.

In lower pocket 38, there is shown a two-part beach umbrella 64*a*, 64*b* which extends horizontally through the lower pocket. Other than a beach umbrella, the lower pocket 38 may hold a golf umbrella or a chair umbrella having similar overall configuration. The lower pocket 38 may also hold other narrow elongated articles which will fit within the dimensions of the pocket to be transported in this similar manner.

If the carrier 10 is being utilized to transport items for beach use, one of the external attachment means 46 shows a pail 66 and shovel 68 which are generally used by children to dig in the sand. The other external attachment means 48 is shown without any article suspended therefrom. However, both of the external attachment means 46, 48 may be utilized in tandem to support and carry any elongated article such as a chair umbrella or secondary sand umbrella or rolled towels so long as the overall diameter of the article(s) to be carried does not exceed the length of the distending adjustable strap from either external attachment means 46, 48.

Of course, even though one or more chairs may be carried within the space formed between the first and second sides 12, 14 of the carrier 10, that same space may be utilized to carry other collapsible items having dimensions which either adapt or fit within the overall dimensions of the first and second sides 12, 14 of the carrier 10. Additionally, towels or other soft articles such as clothing, beach shoes, etc. can be placed within the open spaces between the support surfaces of the collapsed chair.

When the carrier 10 has been emptied of all of the articles, the carrier 10 may be opened and laid flat so that it can be used for sitting or laying down.Hence, the carrier 10 provides for a unified combination carrier which can easily transport a number of articles having a variety of different shapes and sizes while permitting the hands of the individual transporting the carrier to remain free for other purposes.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

We claim:

1. A carrier permitting a user to transport folding beach chairs and other articles used when said user is pursuing recreational activities comprising in combination:

generally flat rectangular body said rectangular body having two long sides and two shorter sides, said body adapted to be folded along a line transverse to the long sides of said rectangular body at a location generally equidistant from said shorter sides to define a carrier open along three juxtaposed edges when said body is folded, said carrier sized to accommodate one or more folding chairs inside said body when folded;

a pair of handles, with one handle being attached to each shorter side of said body;

at least one adjustable fastener means positioned along each of said open sides of said carrier to hold said carrier in a closed position;

article carrying pockets having an opening generally parallel to one of said shorter sides on one of one-half of an inner-surface or one-half of an outer surface of said body;

at least one adjustable utility fastener means on an outside surface of one of said sides to attach an article to said body; and at least one transverse umbrella pocket on an outside surface of said body, said pocket extending across said outer surface of said body.

2. The carrier of claim 1, further including a pocket on an inner surface of said body.

3. The carrier of claim 2 wherein the pocket is dimensioned to extend substantially across said inner surface of said body to a width in the range of 18 to 20 inches and to extend vertically along said inner surface to a height in the range of 16 to 18 inches.

4. The carrier of claim 1, wherein a plurality of article retaining means are arranged horizontally across an outer surface of one-half of said body as a series of upwardly opening vertically oriented pockets.

5. The carrier of claim 4, wherein there are three vertically oriented pockets having a vertical dimension in the range of 10 to 12 inches, with two outer pockets having a horizontal dimension in the range of 6 to 8 inches, and a center pocket having a horizontal dimension in the range of 8 to 9 inches.

6. The carrier of claim 1, wherein said umbrella pocket is adjacent to the midline of said carrier and extends horizontally from edge to edge of said body with a vertical dimension of said pocket being in the range of 6 to 8 inches.

7. The horizontally extending carrier of claim 6, wherein said umbrella pocket is configured to hold and retain elongated articles placed or positioned within said pocket from either end of the pocket.

8. The carrier of claim 1, further comprising a plurality of adjustable utility attachment means for carrying bulky articles on said outer surface of said carrier.

9. The carrier of claim 8, wherein said adjustable utility attachment means comprises one or more side-pinch adjustable strap buckle means for securing and supporting said article.

10. The carrier of claim 1, wherein the adjustable length fastener means is of the side-pinch adjustable strap buckle type.

* * * * *